United States Patent [19]

Ligones et al.

[11] 4,244,169

[45] Jan. 13, 1981

[54] DEVICE FOR JOINING TEXTILE YARNS BY AXIAL TWISTING

[75] Inventors: Hubert Ligones, Pont-St-Esprit, France; Laurent Kropf, Lausanne; Erwin Zürcher, Le Lignon, both of Switzerland

[73] Assignee: Fomento de Inversiones Industriales S.A., Barcelona, Spain

[21] Appl. No.: 47,649

[22] Filed: Jun. 11, 1979

[30] Foreign Application Priority Data

Jun. 12, 1978 [CH] Switzerland ..... 6379/78

[51] Int. Cl.[3] ..... B65H 69/06

[52] U.S. Cl. ..... 57/22

[58] Field of Search ..... 57/22, 23, 202

[56] References Cited

U.S. PATENT DOCUMENTS

| | | | |
|---|---|---|---|
| 1,239,560 | 9/1917 | Brigham | 57/22 |
| 1,396,618 | 11/1921 | Bennett | 57/22 |
| 1,611,365 | 12/1926 | Peterson | 57/22 |
| 2,362,801 | 11/1944 | Charnock | 57/22 |
| 2,765,003 | 10/1956 | Willis et al. | 57/22 X |
| 3,675,407 | 7/1972 | LaRue | 57/22 |
| 3,729,913 | 5/1973 | Wray | 57/22 |
| 3,903,680 | 9/1975 | Isern | 57/22 |

*Primary Examiner*—John Petrakes

*Attorney, Agent, or Firm*—Karl F. Ross

[57] ABSTRACT

A device for joining together two ends of a yarn in order to recreate the initial structure of the yarn comprises two heads provided with radial slots and fixed to rods which are rotatable in order to take up the yarn by means of the slots and to wind the yarn about the rods. The free ends of the yarns are untwisted and subjected to electrostatic fields created between the heads and an annular electrode. Rotating the heads in the opposite direction then causes the yarns to unwind from the rods and the fibres of the two ends of the yarn to twist together, the yarn then being released.

5 Claims, 7 Drawing Figures

Figure 1:
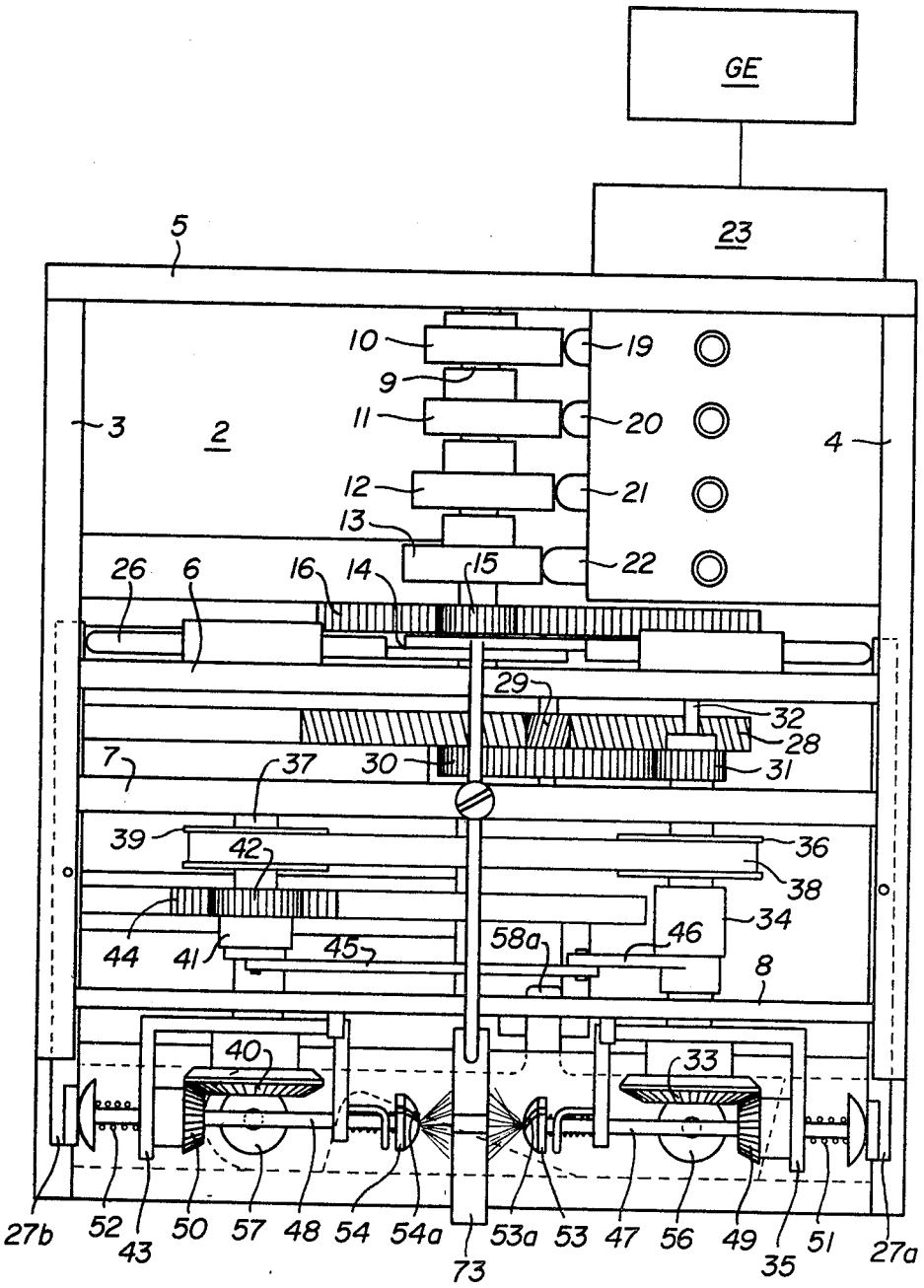

FIG. 6
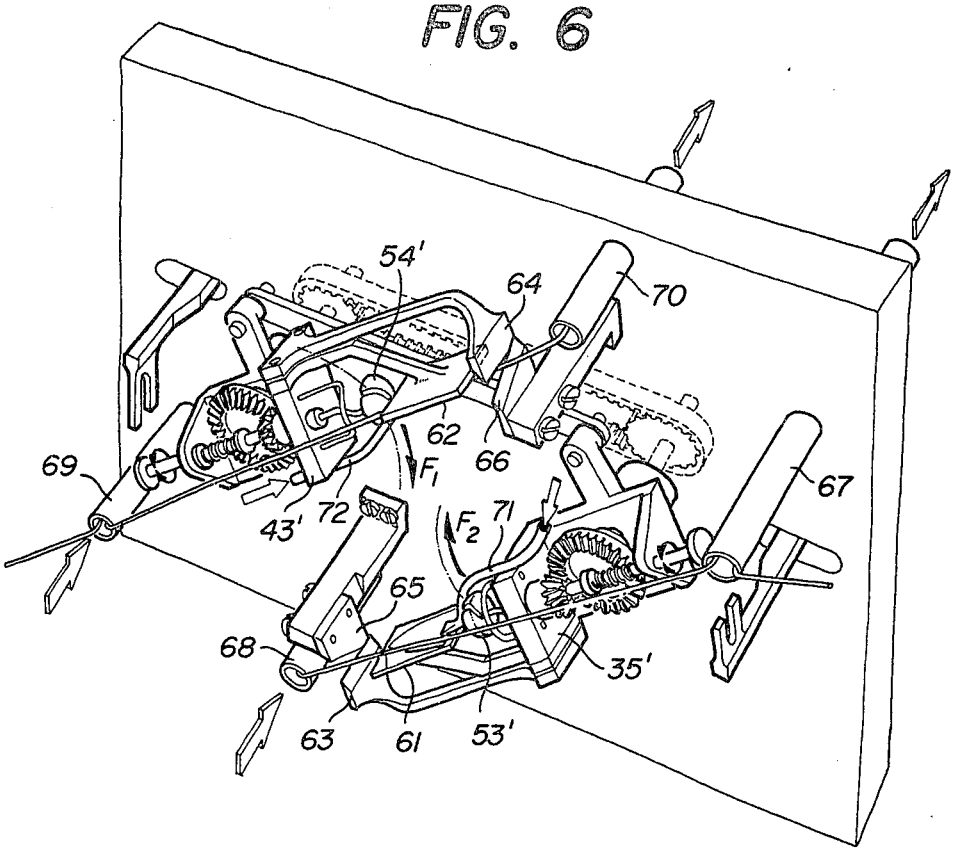
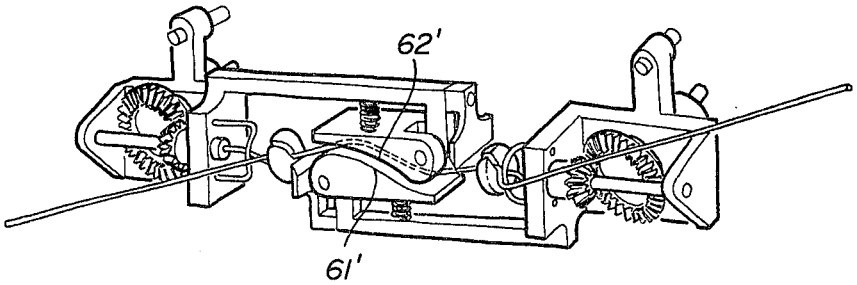
FIG. 7

DEVICE FOR JOINING TEXTILE YARNS BY AXIAL TWISTING

This invention relates to devices for joining textile yarns.

Joining together textile yarns is an operation which is frequently necessary in many processes in which yarn is manufactured or used. Joining is done by various means ranging from simple knotting, which is by far the commonest method, to reconstituting the yarn issuing from the spinning process by passing it through a glueing operation, winding a filament about two ends placed side by side, etc.

When it is required to make a joint in which the spun condition is re-created, it is necessary to untwist the fibres in the proximity of the two ends, then to associate the fibres with each other as intimately as possible, and then to axially twist the two ends. This axial twisting is possible only to the extent by which a false twist has previously been induced in that portion of the yarn adjacent to each end to be rejoined.

One of the problems of this type of joint is the release of the yarn from the apparatus after the joint has been made, because the joint itself prevents the use of traditional grips which, although they are able to insert the ends to be joined, cannot pull out the yarn laterally after the rejoining. Under these conditions, the apparatus would probably have to be kept in the same working position just for occasional use. Consequently, in order to avoid so much idle time, U.S. Pat. No. 2,362,801 has already proposed a system by which the yarn can be inserted laterally for joining its ends so that it can be disengaged once the joint has been made. Joining by twisting requires a rotary gripping member for each yarn end. This rotary gripping member must comprise a slot for inserting the yarn, this slot being provided both in this member and in its support column, so that the two slots must be perfectly aligned when the yarn is inserted and when it disengaged. This method is obviously complicated, as the exact positioning of the slot in the rotating grip poses delicate problems, as does the insertion of the yarn into this slot.

The object of the present invention is to at least partly obviate the drawbacks of the aforesaid devices.

To this end, the present invention provides a device for joining textile yarns by twisting the respective yarn ends about their axes, comprising means for untwisting the end portions of the yarns and for imposing an excess twist on the yarn portions adjacent to said end portions, and for then transferring this excess twist to the end portions in order to cause them to join together, which means comprise two substantially coaxial spindles rotatably mounted in respective supports and kinematically linked one to the other so that they rotate in reverse directions to each other, each of which spindles comprises a rod of which that end facing the other spindle has a hooking element extending radially to the rod axis, drive means for rotating said spindles alternately in two respective directions of rotation, and means for stretching a respective yarn in the path of each said hooking element such that its rotation in one of said directions of rotation of the spindle winds a portion of said yarn as a helix onto said rod while the yarn end portion is being untwisted, and such that its rotation in the other direction of rotation of the spindle unwinds the wound portion of yarn and twists its end portion together with the end portion of the yarn wound on the other spindle, these joined yarns being released simultaneously from said spindles as said helix-wound portions become unwound.

The essential advantage of the present device resides in the fact that the excess twist is provided simultaneously with the gripping of the yarn, and the twisting of the yarn ends for joining them is effected simultaneously with the release of the yarn. In addition, the gripping and release of the yarn are automatic.

Figure 2:
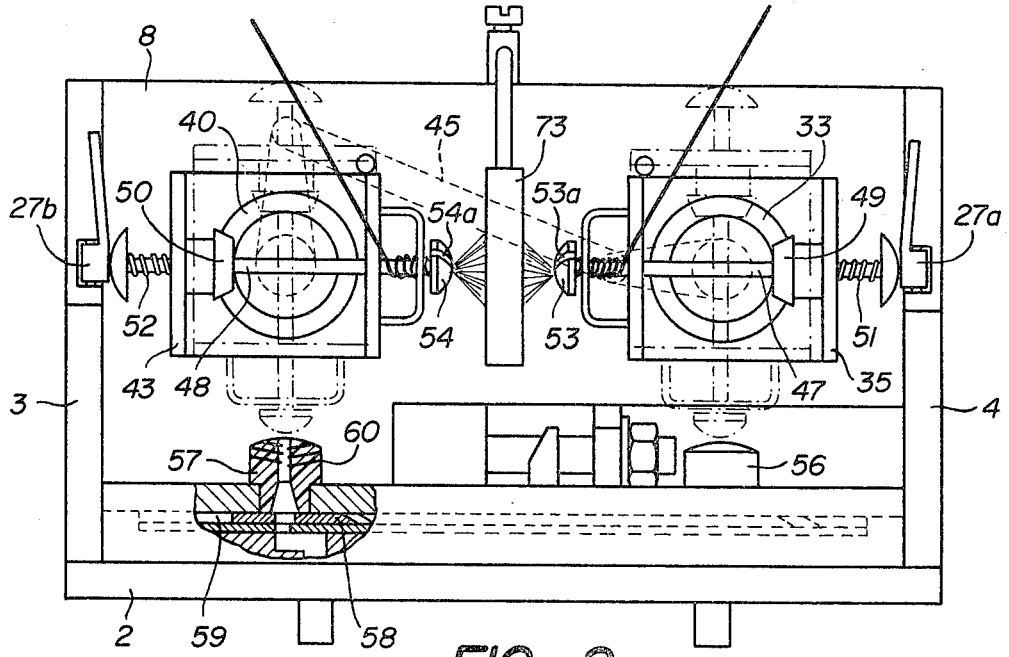
Figure 3:
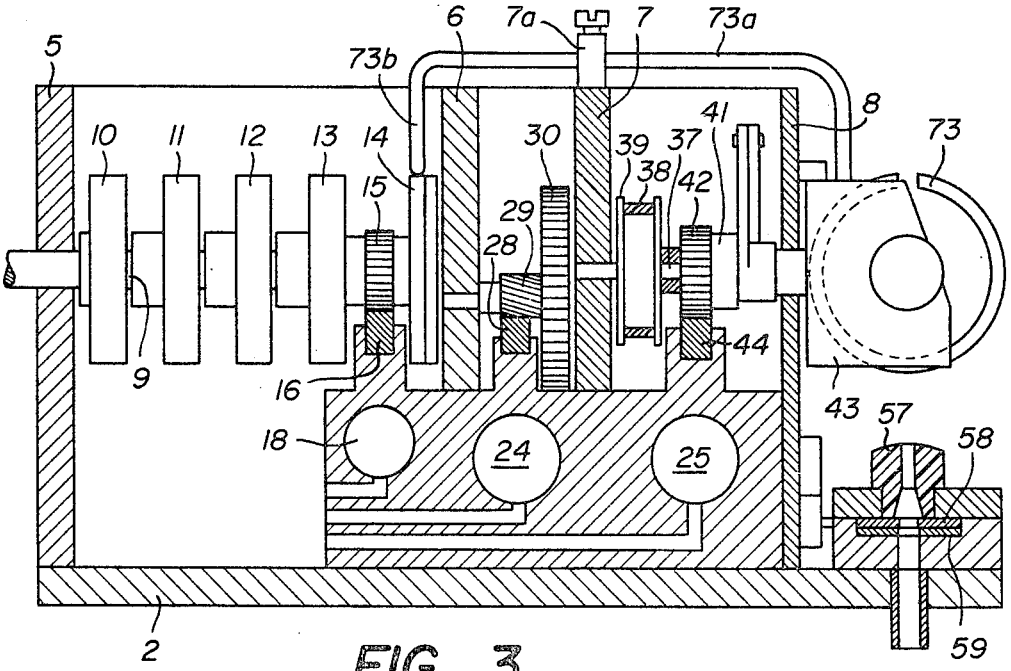
Figure 4:
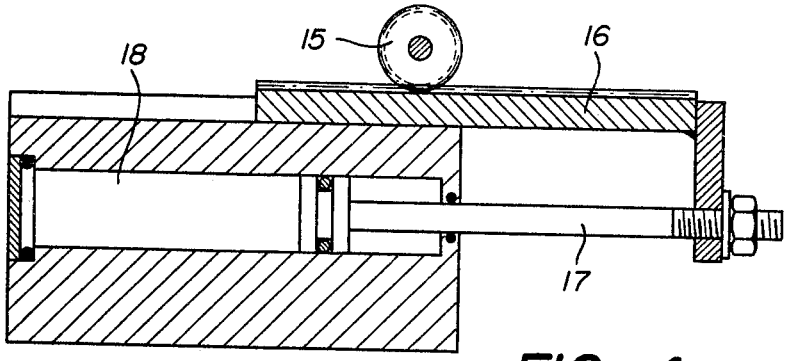
Figure 5:
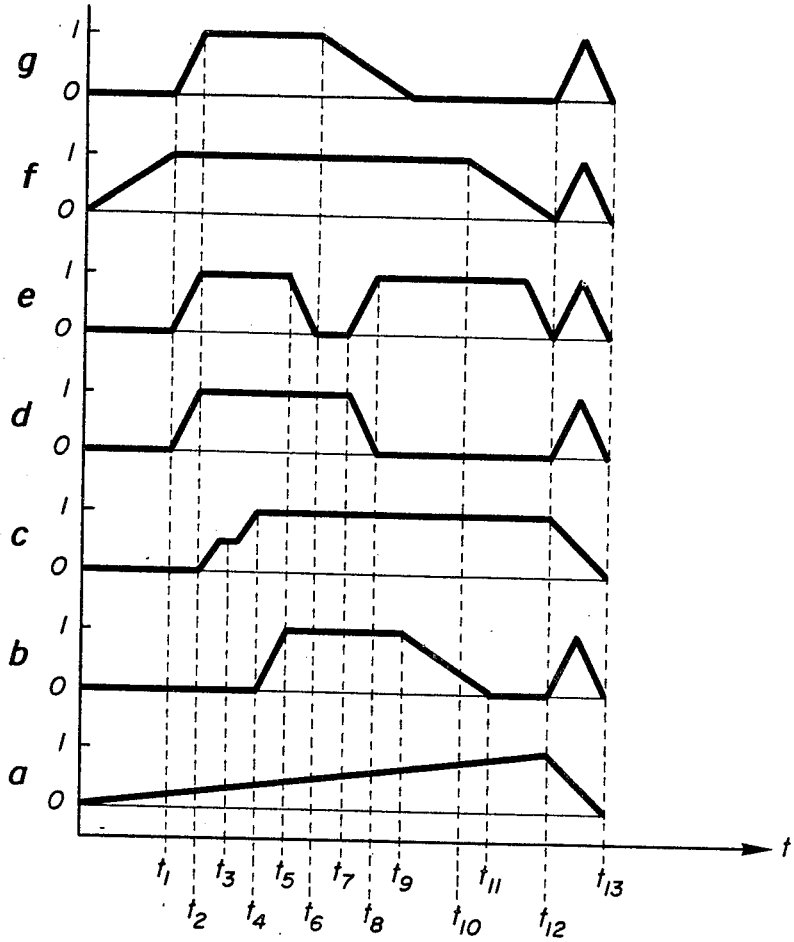

These and further advantages will be apparent from the description given hereinafter with reference to the accompanying drawings which diagrammatically illustrate two embodiments of the present invention, by way of example. In the drawings:

FIG. 1 is a plan of a first device embodying the invention for joining yarn ends, FIG. 2 is a view on the line II—II of FIG. 1, FIG. 3 is a view on the line III—III of FIG. 1, FIG. 4 is a view on the line IV—IV of FIG. 3, FIG. 5 is an operational diagram of the device, FIG. 6 is a perspective view of the front part of a second yarn-joining device embodying the invention, and FIG. 7 shows a detail of a modification of the device of FIG. 6, illustrating the device in another position.

The device shown in FIGS. 1 to 4 has a frame comprising a base plate 2, two lateral walls 3 and 4 and four transverse walls 5, 6, 7 and 8. A cam shaft 9 is rotatably mounted between the walls 5 and 6 (FIGS. 1 and 3). This shaft carries five cams 10, 11, 12, 13 and 14, and a pinion 15 which meshes with a rack 16 (FIGS. 3 and 4) rigid with the piston 17 of a double-acting cylinder 18. Each cam 10 to 13 operates a pusher 19, 20, 21, 22 respectively for operating a valve (not shown). Each of these valves controls one of the functions of the device. The cam 10 controls an electropneumatic switch 23, the cam 11 controls the cylinder 18, the cam 12 controls a cylinder 24, the cam 13 controls a cylinder 25; the cam 14 controls a double arm 26 for operating two levers **27*a* and 27*b*** pivoted about vertical axes at their centres.

The cylinder 24 controls a rack 28 meshing with a pinion 29 of a reduction gear train comprising a gear 30 rigid with the same shaft as the pinion 29, which meshes with a pinion 31. This pinion 31 is keyed onto a shaft 32 which is journalled at one end in the wall 6, passes through the walls 7 and 8, and terminates in a bevel pinion 33 at its other end. This shaft passes through a sleeve 34 which is pivoted in the wall 8, and carries a support 35 at its front end. A pulley 36 is keyed onto the shaft 32 and transmits the rotation of this shaft to a parallel shaft 37 by way of a belt 38 and a pulley 39 keyed onto the shaft 37.

The shaft 37, which carries a bevel pinion 40 at its front end, passes through a sleeve 41 pivoted in the wall 8. This sleeve terminates in a pinion 42 at its rear end and a support 43 at its front end. The pinion 42 meshes with a rack 44 rigid with the rod of the cylinder 25 controlled by the cam 13. The sleeve 41 is made kinematically rigid with the sleeve 34 by a connecting rod 45 hinged at one end to the sleeve 41 and at the other end to a crank 46 rigid with the sleeve 34.

Each of the supports 35 and 43 carries a spindle constituted by a rod 47 and 48 respectively, extending perpendicularly to the axis of the shaft 32 and to the axis of the shaft 37 respectively, each spindle rod being rotatably and slidably mounted in its support. Each rod 47, 48 carries a bevel pinion 49, 50 respectively, meshing with the level pinions 33, 40 respectively. Said rods 47, 48 are resiliently urged against the levers **27*a*, 27*b* respectively by springs 51, 52 respectively. The other ends of said rods terminate in heads 53, 54 respectively, in the form of spherical caps and each comprising a radial slot 53***a*, 54*a* respectively. The two supports 35 and 43 are electrically insulated from earth and can be connected selectively to the terminals of an electrostatic generator GE by the electropneumatic change-over switch 23.

Two tubular conduits 56 and 57 (FIG. 2) pass through the base plate 2, for connection to a suction source (not shown). A double cutter 58 is slidably mounted in a groove 59 to cut the yarn at the exit of each of the tubes 56 and 57. The double cutter 58 is connected to the rack 44 by an arm 58*a* (FIG. 1). The tubes 56 and 57 are provided with comb teeth 60 (FIG. 2).

A ring 73 constituting an electrode is fixed by an arm 73*a* to an insulating support 7*a*, and can be selectively connected to earth by the end 73*b* of the arm 73*a* coming into contact with one of the double cams 14. Said ring 73 is coaxial with the rods 47 and 48 when the latter are aligned axially with each other.

To join the two ends of a yarn, each of said ends is inserted into one of the tubes 56 and 57. The suction created in these tubes exerts a traction on each portion of yarn. The length of yarn inserted into each tube 56, 57 depends upon the amount of yarn which it is required to eliminate. This is particularly the case in a yarn cleaning system in which a certain length of yarn is to be removed. The length of the tubes 56 and 57 determines the length of yarn which extends beyond each head 53 and 54, this length being a function of the average length of the fibres. During this first stage of the operation, the supports 35 and 43 are in the position shown by dashed and dotted lines in FIG. 2, the rods 47 and 48 having their axes vertical, and the heads 53 and 54 facing downwards.

As the yarn is sucked into each tube and is held at its other end, a certain tension results which presses the yarn against each head 53 and 54. At this moment, the cylinder 24 operates the rack 28 which drives the pinion 29, the gear wheel 30, the pinion 31 keyed onto the shaft 32, the pulley 36, and the bevel pinion 33 which meshes with the bevel pinion 49 of the rod 47 rigid with the head 53. On rotating, the slot 53*a* in this head comes into alginment with the yarn which, because of its tension, enters the slot. The yarn is then entrained by this slot and winds helically around the rod 47. Simultaneously, because of rotation of the head 54 by the drive belt 38, the other portion of yarn winds helically around the rod 48 but in the reverse direction. The winding directions are chosen so that each winding corresponds to the direction of twist in each portion of yarn, and the number of turns is determined by the stroke of the cylinder 24 and by the ratio of the reduction system, and is chosen as a function of the twist to be inducted in order to rejoin the two portions of yarn.

The cylinder 25 then drives the rack 44. The toothing on this rack is constructed so that it does not engage immediately with the pinion 42, and instead during the first stage of the movement of the rack only the double cutter 58 is driven and cuts the yarn at the exit of each tube 56 and 57. Only then does the rack 44 engage with the pinion 42 to rotate the support 43 through one quarter of a turn in an anti-clockwise direction (as viewed in FIG. 1), and simultaneously because of the connecting rod 45 and arm 46, the support 35 is likewise rotated in the clockwise direction, so that the two rods 47 and 48 are axially in line with each other. During this movement of the supports 35 and 43, the yarn portions are withdrawn from the tubes 56 and 57, and the teeth 60 comb the fibres so as to untwist them.

When the heads 53 and 54 reach the position shown in FIG. 1 and shown by solid lines in FIG. 2, the change-over switch 23 controlled by the cam 10 and pusher 19 has already connected the heads 53 and 54 to the respective terminals of the electrostatic generator GE, so that an electrostatic field is created between the two heads 53, 54 which form two electrodes of different polarity. An electrostatic field is also established between that of the heads 53 and 54 which is at the negative potential of the generator, and the electrode 73 connected to earth. Each yarn is thereby charged to the potential of the head on which it is wound, and is for this reason attracted by the neighbouring head and by the electrode 73 in the case of the negatively charged fibres, as shown in FIGS. 1 and 2. The respective polarities of the heads 53, 54 are then reversed several times to the switch 23 so that the fibres of the two yarn ends to be joined alternately opened and closed and thus become tangled with each other. The electrode 73 fixed to the insulating support 7*a* is then disconnected from earth, so that the fibres are no longer attracted towards it, but instead tend to fall back towards the axis of the yarn. This stage is followed by traction being exerted, controlled by the double cam 14 and by the springs 51 and 52 which push the levers 27*a* and 27*b* and the double arm 26 (FIG. 1), to slightly withdraw the heads 53, 54 from each other, so exerting a traction on the intermingled fibres which slide against each other to assume properly parallel positions.

The electrostatic field is then interrupted by the cam 10 and pusher 19, and the cylinder 24 moves the rack 28 backwards so that the rods 47, 48 turn in directions which are respectively the reverse of the directions of rotation of said rods when the yarn was gripped. The yarn accordingly unwinds from the rods 47 and 48, and the yarn portions located between the heads 53 and 54 twist. When the entire yarn has unwound and the joint has been made at its ends, the yarn is automatically released from the heads 53, 54 in that a certain tension is exerted on the yarn and it then emerges laterally from the respective slots 53*a*, 54*a*. The rejoining operation is then complete.

The operational diagram of FIG. 5 shows in which chronological order the cams 10 to 14 of the cam shaft 9 control the various stages of the described rejoining cycle. Apart from the cam 14 which retracts the arms 26 when traction is to be exerted on the intermingled yarn ends and the electrode 73 is to be connected to earth, this cam being a purely mechanical device, all the other functions including the control of the switch 23 are pneumatic.

In FIG. 5, the function a represents the displacement of the cylinder 18, function b the control of the movement of the rods 47 and 48 by the cam 14 and levers 27*a* and 27*b*, function c the displacement of the cylinder 25, functions d and e the application of electricity to the rods 47 and 48, function f the displacement of the cylinder 24, and function g the connection to earth of the electrode 73.

The time to corresponds to the start of operation of the cylinder 18 for driving the cam shaft 9, and simultaneously the start of operation of the cylinder 24 which controls the rotation of the rods 47 and 48 in the direction for untwisting the free ends of the yarn portions to be rejoined, and the false twist or excess twist of these yarn portions. It is during this operation that these yarn portions, inserted into the suction tubes 56 and 57 (FIG. 2), enter the slots 53*a*, 54*a* in the heads 53, 54 respectively. At time $t_1$, the rods 47 and 48 stop turning and are electrified by the generator GE (functions d and e), and the electrode 73 is connected to earth (function g). When the rods 47 and 48 are electrified, function c commences at time $t_2$, and corresponds between time $t_2$ and $t_3$ to the displacement of the rack 44 and of the double cutter 58, followed by the pivoting of the supports 35 and 43 from time $t_3$ to $t_4$, accompanied by the combing of the yarn ends. The time $t_4$ is the start of function b in which the rods are brought together by the cam 24 and levers 27*a*, and 27*b* until time $t_5$, starting from which the polarities of the rods 47, 48 are reversed successively as illustrated by the functions e and d from time $t_5$ to $t_8$. At time $t_7$, the electrode 73 is insulated from earth (function g). At time $t_9$ the rods 47 and 48 are separated from each other (function b), and at time $t_{10}$, during the end of this withdrawal of the rods 47 and 48 which terminates at time $t_{11}$, the rods are rotated in order to twist the fibres of the two ends until time $t_{12}$, which also marks the end of the cycle. From $t_{12}$ to $t_{13}$ all the functions are returned to their initial position by retraction of the cylinder 18 which controls the cam shaft 9 (function a).

The apparatus is now ready to carry out a further rejoining operation, the yarn having been automatically disengaged from the rods 47 and 48 and from their heads 53 and 54 respectively at the end of the operation in which the ends to be joined were twisted, and during which the yarn was unwound from the rods 47 and 48.

FIG. 6 shows a modification in which an electrode, 61 and 62 respectively, is associated with each head 53', 54' respectively. These electrodes are connected to the electrostatic generator (now shown in this figure), and are arranged to attract the untwisted combed ends of the yarns to be rejoined. For this purpose, they are covered with a thin layer of a dielectric material, which in this example is a layer of "Teflon" (Registered Trade Mark) 0.2 mm thick. The purpose of this dielectric material is to enable the yarn charged to the potential opposite to the electrode potential to be attracted by this electrode but to continue to maintain its own potential because of the dielectric. Consequently, in this modification, the fibres subjected to the electrostatic field do not open circularly as in the case of the previous embodiment, but rest against the surfaces of the electrodes 61, 62 respectively.

Each head 53', 54' is provided with a cutter blade 63, 64 fixed to the support 35', 43' respectively. Fixed cutter blades, 65, 66 are disposed in the circular paths of the movable blades 63, 64 respectively. In the position illustrated in FIG. 6, the blades of each pair 63, 65 and 64, 66 respectively are on opposite sides of the associated yarn, which is stretched between two suction tubes 67, 68 and 69, 70 respectively. A blowing nozzle 71, 72 respectively is associated with each electrode 61, 62, and is disposed in such a manner as to blow air substantially along the yarn axis. Thus, a yarn wound about the rods 47', 48' in a direction such that it becomes untwisted between the heads 53', 54' and the tubes 68, 70 respectively, will then be combed by the compressed air blown by the nozzles 71 and 72. This combing releases the fibres which are not bonded to that part of the yarn wound about the rods 47', 48' respectively, and those parts of the yarn engaged in the suction tubes 68, 70 respectively will be separated and sucked so that only those untwisted fibres which are bonded to the rest of the yarn will remain, and these will then be attracted against the faces of the electrodes 61, 62 respectively by the effect of the electrostatic field.

The two supports 35' and 43' are then swivelled in the direction of the arrows $F_1$, $F_2$ as explained with reference to FIGS. 1 to 4, until the electrodes 61 and 62 come into contact and clamp the two yarn ends to be rejoined one against the other.

This swivelled position of the electrodes is shown in FIG. 7, which also shows a modification in which the electrodes 61' and 62' are not flat as shown in FIG. 6, but are formed with respective surfaces which curve in opposite directions so as to create traction on the yarn ends to be rejoined. The actual rejoining is then carried out by twisting the yarn ends which are in contact between the electrodes, by rotating the heads 53' and 54', at the same time releasing the yarn from the slots 53'*a* and 54'*a*, as described with reference to FIGS. 1 to 4.

Tests have shown that it is possible to make totally invisible joints having a tensile strength exceeding 80% of the initial tensile strength of the yarn. The first embodiment described has enabled excellent results to be obtained, especially for yarns using relatively flexible fibres and/or fibres which are easy to charge electrically, whereas in the case of yarns using more rigid fibres and/or fibres which are difficult to charge electrically, such as wool, the embodiment shown in FIG. 6 or its modification of FIG. 7 have given better results.

It should also be stated that in order to improve the uniformity of the yarn cross-section, and not to create weak points in the locality of the joint, it is advantageous to cut off those end portions in which the fibre density is very low, so that the two end portions when twisted together have a fibre density which is as close as possible to the initial fibre density of the yarn.

We claim:

1. A device for joining textile yarns by twisting the respective yarn ends about their axes, comprising means for untwisting the end portions of the yarns and for imposing an excess twist on the yarn portions adjacent to said end portions, and for then transferring this excess twist to the end portions in order to cause them to join together, which means comprise two substantially coaxial spindles rotatably mounted in respective supports and kinematically linked one to the other so that they rotate in reverse directions to each other, each of which spindles comprises a rod of which that end facing the other spindle has a hooking element extending radially to the rod axis, drive means for rotating said spindles alternately in two respective directions of rotation, and means for stretching a respective yarn in the path of each said hooking element such that its rotation in one of said directions of rotation of the spindle winds a portion of said yarn as a helix onto said rod while the yarn end portion is being untwisted, and such that its rotation in the other direction of rotation of the spindle unwinds the wound portion of yarn and twists its end portion together with the end portion of the yarn wound on the other spindle, these joined yarns being released simultaneously from said spindles as said helix-wound portions become unwound.

2. A device as claimed in claim 1, in which each of said supports is mounted rotatably about an axis orthogonal to the rod axis, and said supports are kinematically linked one to the other so that they rotate in opposite directions to each other, and in which the drive means are associated with said supports in such a manner as to displace them from a position in which said rods are coaxial to a position in which the rods are parallel and in which said heads lie opposite respective apertures connected to a suction source and each lies adjacent to a yarn cutting member.

3. A device as claimed in claim 1 in which each of said rods is insulated from earth and is selectively connectable to an electrostatic generator.

4. A device as claimed in claim 3 in which an annular electrode is disposed between said heads, coaxially to the axis of said rods when the latter are coaxially aligned, and is selectively connectable to one of the poles of said generator.

5. A device as claimed in claim 1, in which each of said rods is connected to one of the poles of an electrostatic generator and thus constitutes a first electrode, and a second electrode is associated with each of these rods and is constituted by a contact surface extending in line with the respective rods, at that end of the rods at which they terminate in said heads, said second electrodes being connected to the other pole of said generator, each pair of first and second electrodes being mounted on a respective swivel support such that said second electrodes can selectively occupy a first position in which they are spaced from each other, and/or a second position in which they are in contact, the contact surfaces of said second electrodes being of complementary shape to each other.

* * * * *